United States Patent [19]

Wilson

[11] 4,034,896

[45] July 12, 1977

[54] DIAPHRAGM CONTROLLED GARDEN AND ORCHARD SPRAYER

[76] Inventor: Walon K. Wilson, 2441 Adams St., Hollywood, Fla. 33020

[21] Appl. No.: 641,922

[22] Filed: Dec. 18, 1975

[51] Int. Cl.[2] ..... B65D 35/28

[52] U.S. Cl. ..... 222/95; 220/5 R; 220/85 B

[58] Field of Search ..... 222/95, 386.5, 395, 222/465–468, 185; 239/320–323; 220/5 R, 85 B, DIG. 1, DIG. 6

[56] References Cited

U.S. PATENT DOCUMENTS

| | | | |
|---|---|---|---|
| 2,731,297 | 1/1956 | Meyer | 222/386.5 X |
| 2,978,131 | 4/1961 | Garvey | 222/468 X |
| 3,174,658 | 3/1965 | Wittenberg et al. | 222/386.5 X |
| 3,184,113 | 5/1965 | Curtis | 222/386.5 X |
| 3,471,349 | 10/1969 | Cohen et al. | 222/386.5 X |

FOREIGN PATENT DOCUMENTS

| | | | |
|---|---|---|---|
| 998,182 | 7/1965 | United Kingdom | 222/95 |

*Primary Examiner*—Robert B. Reeves
*Assistant Examiner*—Fred A. Silverberg
*Attorney, Agent, or Firm*—Clarence A. O'Brien; Harvey B. Jacobson

[57] ABSTRACT

A garden and orchard sprayer having identical canister halves which are bolted together with a flexible diaphragm therebetween for the purpose of containing and spraying insecticides, herbicides, etc. Each shell half is identical so a single mold may be used to form same. Each canister shell has a large mouth opening for filling the canister and a hose connection for applying water pressure to one of said canister halves while allowing flow from the duplicate hose connection on the other canister half for the purpose of spraying. An additional feature of this invention is in the operation thereof wherein the over-all canister need be filled with insecticide solution once and from then on the container has the proper amount of water therein for future mixes without any refilling as a separate step.

5 Claims, 4 Drawing Figures

DIAPHRAGM CONTROLLED GARDEN AND ORCHARD SPRAYER

BACKGROUND OF THE INVENTION

1. Field of the Invention

This invention relates generally to diaphragm controlled spray devices normally used in spraying gardens and orchards.

2. Description of the Prior Art

A common problem with known diaphragm controlled spray devices is the requirement that they be continually emptied and refilled in order for operation thereof, that is, most of the sprayers which operate by water pressure from a normal house faucet and pressure system involve loading the spray device with insecticide, herbicide, etc., and then applying the hose pressure as a means to force the diaphragm against the spray solution in order for the operator to spray the desired trees, foliage, etc. Once the spray solution has been used up, it is then necessary to empty the water which has accumulated in the spray device before the container can again be refilled with spray solution.

Another common problem of known prior spray devices is that numerous parts are required in the assembly thereof which increases the complexity of the over-all spray devices and also increases the cost thereof.

Another very common problem is most known spray devices are complicated in operation and confusing to the home orchard and home gardener who only uses the device infrequently.

Existing prior patents which may be pertinent to this invention are as follows:

| | | |
|---|---|---|
| G.F. Cramer | 1,731,767 | Oct. 15, 1929 |
| E.A. Meyer | 2,731,297 | Jan. 17, 1956 |
| R.T. Cornelius | 3,158,296 | Nov. 24, 1964 |
| E.H. Wittenberg et al | 3,174,658 | Mar. 23, 1965 |
| R.R. Curtis | 3,184,113 | May 18, 1965 |

SUMMARY OF THE INVENTION

An object of the present invention is to provide a diaphragm controlled garden and orchard sprayer which is easy to operate and fill, and of simple construction for use by the home gardener or small orchard operator.

Another object of this invention is to provide a spray device which employs duplicate canister halves with a flexible diaphragm clamped therebetween to simplify and reduce the number of parts and to reduce the cost of the spray device.

A further object of this invention is to provide a diaphragm controlled sprayer which eliminates the normal filling, emptying, refilling, steps of the usual type sprayers.

A feature of the device of this invention is that once filled normally no further filling is ever necessary.

A still further object of this invention is the provision of large mouth openings in each of the cansister ends for ease in preparation of spray solution.

A still further object of this invention is in the provision of handholds at appropriate ends of the spray device for ease in moving and carrying of said device.

One of the big advantages of the sprayer of this invention is in the fact that there are basically only three components thereof, two duplicate canister halves and a flexible diaphragm which is clamped therebetween when said halves are assembled together. This reduction in the number of parts required to complete the spray assembly reduces the cost of same and also reduces the maintenance required.

Another important feature of this spray device is in the fact that once the container is filled with a spray mix and put in operation, under normal use no further refilling of same is necessary, but the pressure feed water which fills the lower portion of the sprayer in initial use is used for the next spray mix by merely inverting the spray device, opening the large mouth cap at the top thereof, and adding the proper mix concentrate to the water already present in the container. The device then is ready for use by supplying pressure to the inlet of the bottom cansister half once again.

Another important feature is that the spray device is semi-automatic in operation in that it will shut itself off once all of the spray mix is consumed.

Another feature is that if the mix solution tends to settle out the cylindrical shape of the device itself, together with the convenient handholds, offer an easy way to shake up, turn over, or roll the container until the settled out mix is again thoroughly dispersed throughout the water and in suspension therein.

While the device of this invention is very useful as has already been described, further uses for the device include the spraying of lawns, flower beds, and large trees. Also, with detergents, it can be useful for washing buildings, automobiles, etc. With a disinfectant solution, animals can be sprayed to control vermin, and their stalls, pens, and buildings can also be sprayed. The device can even spray oils and paints of light viscosity.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
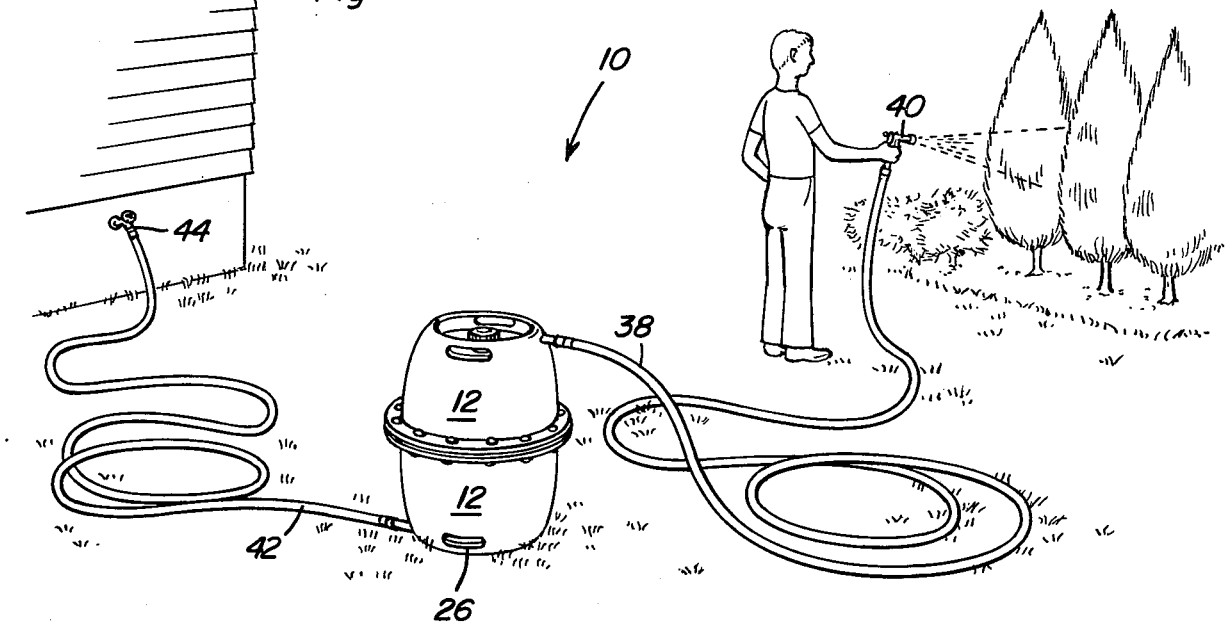
FIG. 1 is a perspective view of the spray device of this invention as in use.
Figure 2:
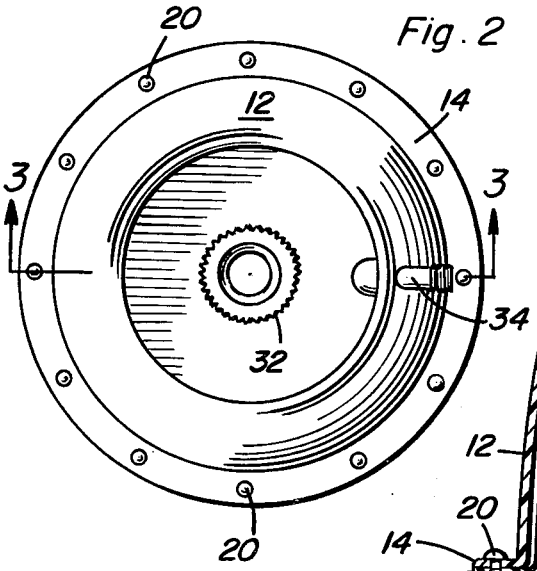
FIG. 2 is a top plan view of the spray device of this invention.

Referring to FIG. 1 of the drawing, reference numeral 10 indicates in general the diaphragm controlled garden and orchard sprayer of this invention. It is shown as being connected by means of an ordinary garden hose 42 to an outside water spigot 44 for pressure feeding the spray mixture through another ordinary garden hose 38 to a spray dispenser control 44 appropriately operated by a person for spraying tress, foliage, gardens, etc.

Figure 3:
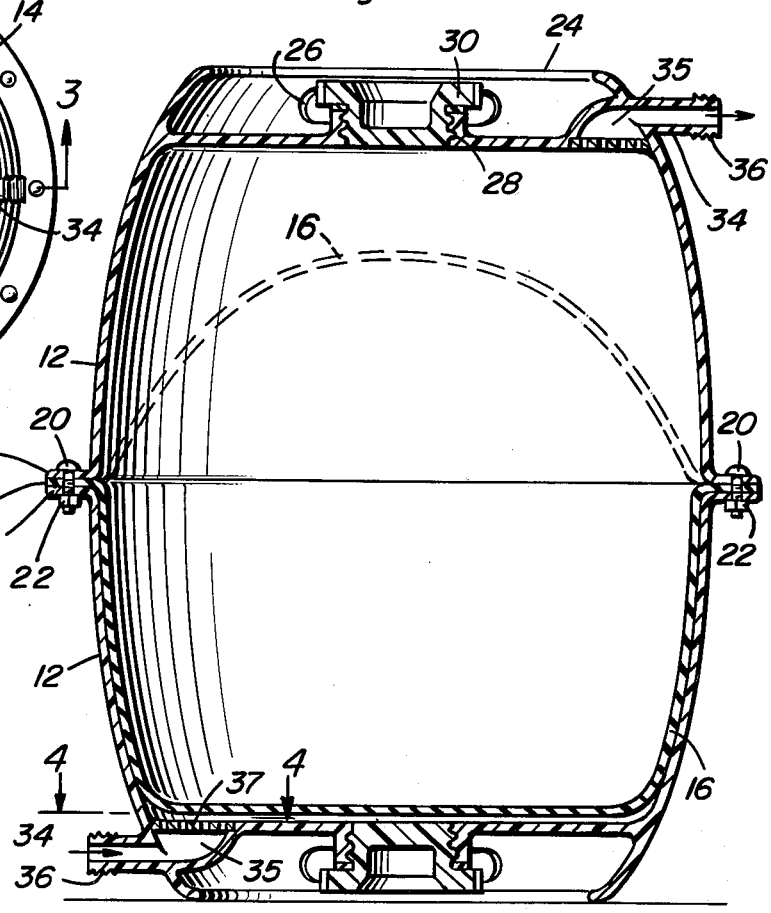
FIG. 3 is a cross-sectional view taken in generally along line 3—3 of FIG. 2.

The spray canister of this invention comprises two indentical half shells 12 with a flexible diaphragm 16 connected therebetween. As seen in FIG. 3, the edges of the diaphragm 18 are clamped between the flange portions 14 of the half shells 12. Circumferential holes are evenly spaced around the flange portions 14 and the diaphragm edge 18 has corresponding holes therein for reception of the bolts 20 and nuts to clamp same 22.

The canister shells may be made of metal, fiber glass, or other plastic materials not affected by spray chemicals. The inner diaphragm 16 may be made of rubber, or flexible synthetic materials. The canister half shells and the entire canister formed thereby may be manufactured in different sizes suitable for the intended use. It may be anywhere from a gallon or two up to 50 or more, depending on the amount of spray needed.

Since the canister halves 12 are indentical they may be made from the same mold which eliminates quite a bit of expense and is part of the simplicity of this invention.

Figure 4:
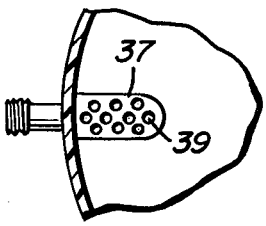
FIG. 4 is a cross-sectional view, in part, taken generally along line 4—4 of FIG. 3.

Each canister half shell 12 is provided with a flanged opening 24 at the end opposite to the flanges 14, with a central, large mouth opening being provided in the end portion of the shell. Reference numeral 28 indicates this opening in FIG. 3. This opening is appropriately provided with screw threads on the inside diameter thereof for reception of a screw-threaded plug 30 therein to close the opening. The plug 30 has appropriate grooves or knurls 32 on the upper outer edge thereof for providing a better handgrip of the plug. Th end portion 24 of the canister shall is provided with two handholds 26 at diametrically opposed sides thereof. Centered between the handholds is an inlet/outlet ordinary garden hose type connection 34 with screw threads 36 thereon. As shown in FIGS. 3 and 1, the bottom hose connector 34 is connected to the pressure hose 42 and the upper, outlet hose connector 34 is connected to the spray hose 38. Normally in assembly of the two canister half shells, the inlet and outlet hose connectors 34 would be turned opposite to each other as shown in FIGS. 1 and 3. To prevent the flexible diaphragm 16 from bulging into the opening 35 at each end of the canister shells a perforated plate 37 (FIG. 4) is provided. The perforations or holes 39 permit unimpeded flow of water and spray mixture, but prevent the diaphragm from entering the openings 35.

Operation of this simple, but unique structure is as follows. The screw-in cap 30 is removed from the top half of the canister and an appropriate spray mixture is poured inside. The diaphragm member 16 is as shown in solid lines in FIG. 3 resting against the inner surface of the lower canister half shell. The spray mix may completely fill the completed canister, as an example assume a five gallon canister is being used, approximately five gallons of the spray mix would be poured into the upper opening 28 to completely fill the canister assembly. The spray hose 38 is then fastened to the top of outlet connection, and the water pressure hose 42 is fastened to the bottom hose connection. Water is then turned on at the faucet 44, creating pressure inside the canister equal to the pressure of the water source. Whenever the spray nozzle is turned on, water will enter from the bottom of the canister, forcing the diaphragm upward, displacing the spray mixture as it leaves the canister. As the spray mixture is used, the diaphragm continues to move upward, displacing the spray mixture until the diaphragm reaches the top of the canister. This is another feature of this invention because when the diaphragm reaches the top of the canister it will automatically shut off the hole to the spray nozzle, and the diaphragm will prevent any flow of the pressure water, so the spray stops, and the canister is filled with approximately five gallons of water from the house water system. Now by turning the canister upside down and reversing the hoses, the top lid can again be removed, this being the lid which was just previously on the bottom, and by taking out a little water sufficient chemical concentrate may be added to the water to form the desired spray mix, the lid is replaced and the canister may be rolled, lifted and shaked, or otherwise agitated to thoroughly mix the concentrate with the water. In the case of readily self-mixing chemicals such agitation is not necessary. In either case once the spray mix is completed, the sprayer is again ready for use. It thus can be seen how once the initial filling has been done, no further emptying or refilling is necessary, as the device actually refills itself while it is being used to spray and is ready for the step of mixing as soon as the previous spray mix is used up.

Some advantages of this diaphragm controlled sprayer are that the user does not spend his time pumping up an air pressure to force the spray mixture out the spray nozzle. Also the diaphragm controlled sprayer of this invention will spray a previously mixed solution with the same force as the source of water supply pressure. A sprayer which mixes the water with chemicals as it sprays loses most of its force from the water hose. Another feature is that the previously prepared spray mix is not diluted by water entering the canister, since the flexible diaphragm separates the two liquids. When the spray mixture has been used up, the sprayer automatically shuts itself off. This diaphragm controlled sprayer is also the only type which refills itself as it uses the spray mixture. And finally, if the spray mixture being used has a tendency to settle out, the diaphragm controlled sprayer of this invention may be turned upside down, rolled, or shaken about in order to keep the mixture stirred. The provision of the rounded egg-shaped structure together with the handholds enable this to be accomplished with relative ease.

Of course, this device may be provided in various sizes and/or used with lesser amounts of spray then the full capacity of the device. For example, with the five gallon size as described above, the operator may desire to only spray one-half gallon, or other fraction of the total capacity. Obviously, just this amount of spray could be added to an empty canister, and then the device would simply spray air until the diaphragm moved up to the point where the spray mixture was under pressure.

The foregoing is considered as illustrative only of the principles of the invention. Furher, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A garden and orchard sprayer assembly for containing and spraying insecticide mixes and the like comprising: means so that the assembly needs to be filled only once including; two identical canister half shells for the assembly each formed with an open end and a substantially closed end, an outer radially extending flange circumferentially around the open end of each canister half shell, the substantially closed end of each canister half shell having an axially extending flanged end portion concentric with the canister walls, a central large mouth opening in the closed end concentrically within the flange end portion of each canister half shell so as to be below the outer edge thereof so that when the large mouth opening is closed with a complementary large mouth plug and the assembly is resting on a surface by means of the axially extending flanged end portion the plug does not touch the surface, a removable large mouth plug mounted in the said central large mouth opening, diaphragm means mounted between the radially extending flanges of the two shells, and an inlet/outlet opening in the closed end of each canister half shell having a hose connection integral therewith and with a coupling end extending outwardly through the axially extending flanged end portion for connection to an ordinary type garden hose.

2. The structure as set forth in claim 1, wherein the diaphragm means is made of flexible material and functions as a leak sealing gasket between the two canister half shells when said canister half shells are connected together in addition to functioning to separate spray mix from a pressure fluid source.

3. The structure as set forth in claim 2, wherein the canister means includes recessed handholds integral therewith for permitting easy maneuverability of the sprayer assembly.

4. The structure as set forth in claim 1, wherein each identical canister portion is formed of plastic material, and the diaphragm means is formed of flexible, liquid impervious material.

5. The structure as set forth in claim 4, wherein said inlet/outlet opening on the closed end of each canister includes a perforated plate mounted in the opening for preventing the diaphragm from bulging into said opening when under pressure.

* * * * *